US010675731B2

(12) United States Patent
Shinozaki

(10) Patent No.: US 10,675,731 B2
(45) Date of Patent: Jun. 9, 2020

(54) METHOD OF MONITORING A DRESSING PROCESS AND POLISHING APPARATUS

(71) Applicant: EBARA CORPORATION, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 324 days.

(21) Appl. No.: 15/721,211

(22) Filed: Sep. 29, 2017

(65) Prior Publication Data

US 2018/0021920 A1 Jan. 25, 2018

Related U.S. Application Data

(63) Continuation of application No. 14/011,668, filed on Aug. 27, 2013, now Pat. No. 9,808,908.

(30) Foreign Application Priority Data

Aug. 28, 2012 (JP) ..... 2012-187383

(51) Int. Cl.
*B24B 49/18* (2006.01)
*B24B 49/16* (2006.01)

(52) U.S. Cl.
CPC ..... *B24B 49/18* (2013.01); *B24B 49/16* (2013.01)

(58) Field of Classification Search
None
See application file for complete search history.

(56) References Cited

U.S. PATENT DOCUMENTS

| | | | | |
|---|---|---|---|---|
| 6,609,962 | B1 | 8/2003 | Wakabayashi et al. | |
| 6,953,382 | B1 * | 10/2005 | Korovin | B24B 49/18 451/11 |
| 7,828,625 | B2 | 11/2010 | Yu et al. | |
| 2002/0142706 | A1 | 10/2002 | Glashauser et al. | |
| 2008/0242197 | A1 | 10/2008 | Fujita et al. | |
| 2009/0036024 | A1 | 2/2009 | Matsuzaki | |
| 2010/0035525 | A1 | 2/2010 | Deshpande et al. | |
| 2010/0081361 | A1 | 4/2010 | Fukuda et al. | |
| 2010/0311309 | A1 | 12/2010 | Shinozaki | |
| 2012/0064800 | A1 | 3/2012 | Watanabe | |
| 2012/0309267 | A1 | 12/2012 | Shinozaki et al. | |

FOREIGN PATENT DOCUMENTS

| | | | |
|---|---|---|---|
| CN | 102398210 | A | 4/2012 |
| JP | 11-138418 | A | 5/1999 |
| JP | 2006-004992 | A | 1/2006 |

(Continued)

OTHER PUBLICATIONS

Machine translation of JP 2006 004992, attached as pdf (Year: 2006).*

*Primary Examiner* — Brian D Keller
(74) *Attorney, Agent, or Firm* — BakerHostetler

(57) ABSTRACT

A method of monitoring dressing of a polishing pad is provided. The method includes: rotating a polishing table that supports the polishing pad; dressing the polishing pad by pressing a dresser against the polishing pad while causing the dresser to oscillate in a radial direction of the polishing pad; calculating a work coefficient representing a ratio of a frictional force between the dresser and the polishing pad to a force of pressing the dresser against the polishing pad; and monitoring dressing of the polishing pad based on the work coefficient.

8 Claims, 7 Drawing Sheets

(56) References Cited

FOREIGN PATENT DOCUMENTS

| | | | |
|---|---|---|---|
| JP | 2006-255851 | A | 9/2006 |
| JP | 2008-207320 | A | 11/2008 |
| JP | 2009-148877 | A | 9/2009 |
| JP | 2011-530809 | A | 12/2011 |
| TW | 200526359 | A | 8/2005 |
| TW | 200722222 | A | 6/2007 |
| WO | WO 2010/017000 | A2 | 2/2010 |
| WO | WO 2011/139501 | A2 | 11/2011 |

* cited by examiner

METHOD OF MONITORING A DRESSING PROCESS AND POLISHING APPARATUS

CROSS REFERENCE TO RELATED APPLICATIONS

This application is a continuation of U.S. application Ser. No. 14/011,668, filed Aug. 27, 2013, which claims the priority and the benefit of Japanese Patent Application No. 2012-187383, filed Aug. 28, 2012, the entire contents of which are incorporated herein by this reference.

BACKGROUND OF THE INVENTION

Field of the Invention

The present invention relates to a method of monitoring a dressing process of a polishing pad for polishing a substrate, such as a wafer. The present invention further relates to a polishing apparatus.

Description of the Related Art

A polishing apparatus, which is typified by a CMP apparatus, is configured to polish a substrate by moving a polishing pad and a surface of the substrate relative to each other while supplying a polishing liquid onto the polishing pad attached to a polishing table. In order to maintain a polishing performance of the polishing pad, it is necessary to regularly perform dressing (or conditioning) of a polishing surface of the polishing pad by a dresser.

The dresser has a dressing surface with diamond particles secured to the dressing surface in its entirety. The dresser includes a removable dress disk whose lower surface serves as the dressing surface. The dresser is configured to press the polishing surface of the polishing pad while rotating about its own axis and moving on the polishing surface. The rotating dresser scrapes away the polishing surface of the polishing pad slightly, thereby regenerating the polishing surface of the polishing pad.

An amount of the polishing pad (i.e., a thickness of the polishing pad) scraped away by the dresser per unit time is called a cutting rate. It is desirable that the cutting rate be uniform over the polishing surface of the polishing pad in its entirety. In order to obtain an ideal polishing surface, it is necessary to perform a recipe tuning of the pad dressing. In this recipe tuning, a rotational speed and a moving speed of the dresser, a load of the dresser on the polishing pad (which will be hereinafter referred to as a dressing load), and the like are adjusted.

In order to evaluate a surface condition of the polishing pad that has been dressed by the dresser, it is necessary to measure the thickness of the polishing pad after removing it from the polishing table. Moreover, the surface condition of the polishing pad cannot be evaluated until a substrate is actually polished. Accordingly, the recipe tuning of the pad dressing entails consumption of a lot of polishing pads and times.

There have been proposed several methods of evaluating the dressing process by measuring the cutting rate and the dressing load. However, these methods achieve the evaluation of the dressing process by estimating an actual dressing process from the dressing results and the dressing load, and cannot monitor the dressing process itself.

SUMMARY OF THE INVENTION

It is therefore an object of the present invention to provide a method and a polishing apparatus capable of quantifying a work of the dresser on the polishing pad to monitor the pad dressing (pad conditioning) during dressing of the polishing pad.

One embodiment of the present invention is a method of monitoring dressing of a polishing pad. The method includes: rotating a polishing table that supports the polishing pad; dressing the polishing pad by pressing a dresser against the polishing pad while causing the dresser to oscillate in a radial direction of the polishing pad; calculating a work coefficient representing a ratio of a frictional force between the dresser and the polishing pad to a force of pressing the dresser against the polishing pad; and monitoring dressing of the polishing pad based on the work coefficient.

Another embodiment of the present invention is a polishing apparatus for polishing a substrate, including: a polishing table that supports a polishing pad; a table motor configured to rotate the polishing table; a dresser configured to dress the polishing pad; a swing motor configured to cause the dresser to oscillate in a radial direction of the polishing pad; a pressing device configured to press the dresser against the polishing pad; and a pad monitoring device configured to monitor dressing of the polishing pad, the pad monitoring device being configured to calculate a work coefficient representing a ratio of a frictional force between the dresser and the polishing pad to a force of pressing the dresser against the polishing pad, and monitor dressing of the polishing pad based on the work coefficient.

According to the above-described embodiments, the work of the dresser on the polishing pad is quantified as the work coefficient during dressing of the polishing pad. Therefore, it is possible to monitor and evaluate the dressing process of the polishing pad based on the work coefficient.

DESCRIPTION OF EMBODIMENTS

Figure 1:
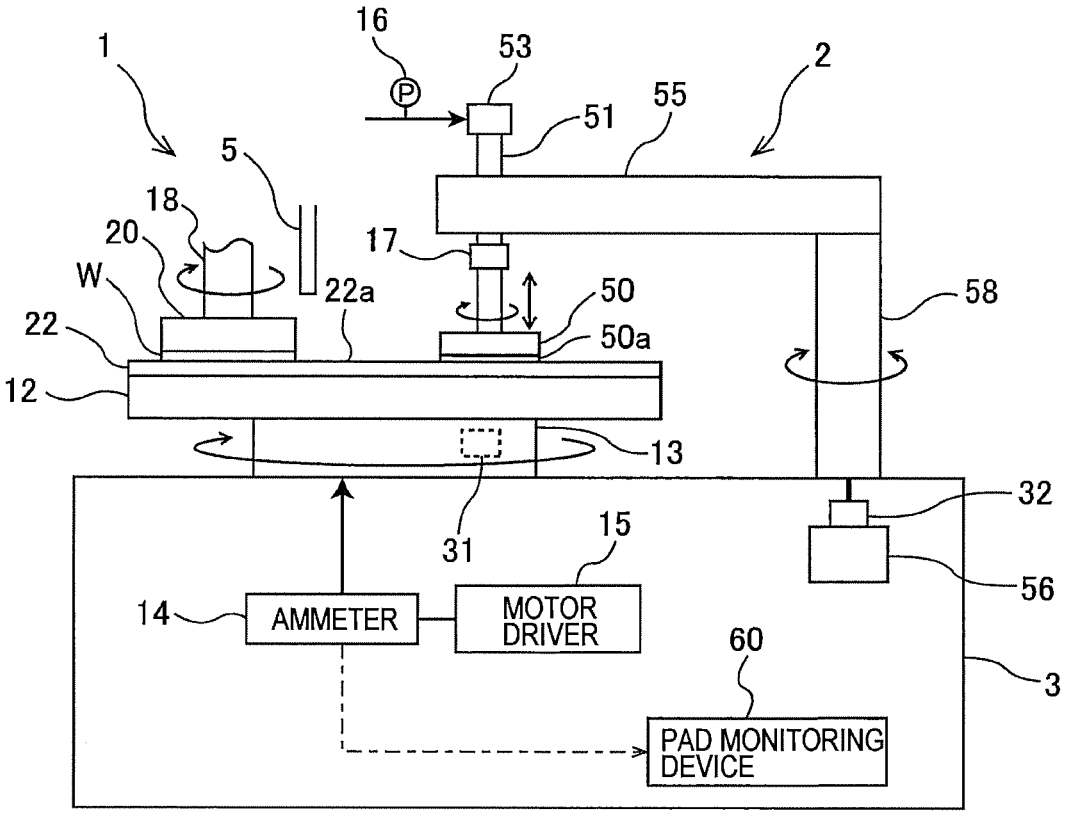
FIG. 1 is a schematic view of a polishing apparatus for polishing a substrate, such as a wafer.

Embodiments will be described below with reference to the drawings. FIG. 1 is a perspective view showing a polishing apparatus for polishing a substrate, such as a wafer. As shown in FIG. 1, the polishing apparatus includes a polishing table 12 supporting a polishing pad 22, a polishing liquid supply nozzle 5 for supplying a polishing liquid onto the polishing pad 22, a polishing unit 1 for polishing a wafer W, and a dressing unit (dressing apparatus) 2 configured to dress (or condition) the polishing pad 22 that is used in polishing of the wafer W. The polishing unit 1 and the dressing unit 2 are mounted to a base 3.

The polishing unit 1 includes a top ring 20 coupled to a lower end of a top ring shaft 18. This top ring 20 is configured to hold the wafer W on its lower surface via vacuum suction. The top ring shaft 18 is rotated by a motor (not shown) to rotate the top ring 20 and the wafer W. The top ring shaft 18 is moved in a vertical direction relative to the polishing pad 22 by a vertically moving mechanism (not shown), which may be constituted by a servomotor and ball screw.

The polishing table 12 is coupled to a table motor 13 disposed below the polishing table 12, so that the polishing table 12 is rotated about its own axis by the table motor 13. The polishing pad 22 is attached to an upper surface of the polishing table 12, and an upper surface of the polishing pad 22 provides a polishing surface 22*a* for polishing the wafer W.

The polishing apparatus further includes a motor driver 15 for supplying a current to the table motor 13, a motor current measuring device 14 for measuring the current supplied to the table motor 13, and a pad monitoring device 60 for monitoring dressing of the polishing pad 22 performed by a dresser 50. The motor current measuring device 14 is coupled to the pad monitoring device 60, so that a measured value of the current is sent to the pad monitoring device 60.

The table motor 13 is controlled so as to rotate the polishing table 12 at a preset constant speed. Therefore, when a frictional force acting between the dresser 50 and the polishing pad 22 changes, the current (i.e., the torque current) flowing into the table motor 13 also changes. More specifically, the larger the frictional force, the larger the torque current required to induce a greater torque for rotating the polishing table 12. The smaller the frictional force, the smaller the torque current required to induce a smaller torque for rotating the polishing table 12. Therefore, it is possible to estimate the frictional force acting between the dresser 50 and the polishing pad 22 from the value of the current supplied to the table motor 13.

Polishing of the wafer W is performed as follows. The top ring 20 and the polishing table 12 are rotated, and the polishing liquid is supplied onto the polishing pad 22. In this state, the top ring 20 with the wafer W held thereon is lowered and presses the wafer W against the polishing surface 22*a* of the polishing pad 22. The wafer W is placed in sliding contact with the polishing pad 22 in the presence of the polishing liquid, so that a surface of the wafer W is polished and planarized.

The dressing unit 2 includes the dresser 50 which is brought into contact with the polishing surface 22*a* of the polishing pad 22, a dresser shaft 51 coupled to the dresser 50, an pneumatic cylinder 53 provided on an upper end of the dresser shaft 51, and a dresser arm 55 which rotatably supports the dresser shaft 51. A lower part of the dresser 50 is constituted by a dress disk 50*a*, which has a lower surface with diamond particles attached thereto.

The dresser shaft 51 and the dresser 50 are movable in unison in the vertical direction relative to the dresser arm 55. The pneumatic cylinder 53 is a pressing device for exerting the dressing load on the dresser 50, which in turn exerts the dressing load on the polishing pad 22. The dressing load can be regulated by pressure of a gas supplied into the pneumatic cylinder 53. This pressure of the gas is measured by a pressure sensor 16. A load cell (i.e., a load measuring device) 17 for measuring the dressing load is incorporated in the dresser shaft 51. While the dressing load can be measured by the load cell 17, it is also possible to calculate the dressing load from the gas pressure measured by the pressure sensor 16 and a pressure-receiving area of the pneumatic cylinder 53.

The dresser arm 55 is actuated by a swing motor 56 to pivot on a support shaft 58. The dresser shaft 51 is rotated by a motor (not shown) disposed in the dresser arm 55, so that the dresser 50 is rotated about its own axis together with the rotation of the dresser shaft 51. The pneumatic cylinder 53 presses the dresser 50 through the dresser shaft 51 against the polishing surface 22*a* of the polishing pad 22 at a predetermined load.

Dressing of the polishing surface 22*a* of the polishing pad 22 is performed as follows. The polishing table 12 and the polishing pad 22 are rotated by the table motor 13, and a dressing liquid (e.g., pure water) is supplied from a dressing liquid supply nozzle (not shown) onto the polishing surface 22*a* of the polishing pad 22. Further, the dresser 50 is rotated about its axis. The dresser 50 is pressed by the pneumatic cylinder 53 against the polishing surface 22*a*, so that the lower surface of the dress disk 50*a* is placed in sliding contact with the polishing surface 22*a*. In this state, the dresser arm 55 pivots on the support shaft 58 to cause the dresser 50 on the polishing pad 22 to oscillate in an approximately radial direction of the polishing pad 22. The polishing pad 22 is scraped by the rotating dresser 50, whereby the polishing surface 22*a* is dressed.

The polishing apparatus further has a table rotary encoder 31 for measuring a rotation angle of the polishing table 12 and the polishing pad 22, and a dresser rotary encoder 32 for measuring a revolution angle of the dresser 50 (i.e., the dresser arm 55). The table rotary encoder 31 and the dresser rotary encoder 32 are an absolute encoder designed to measure an absolute value of the angle.

Figure 2:
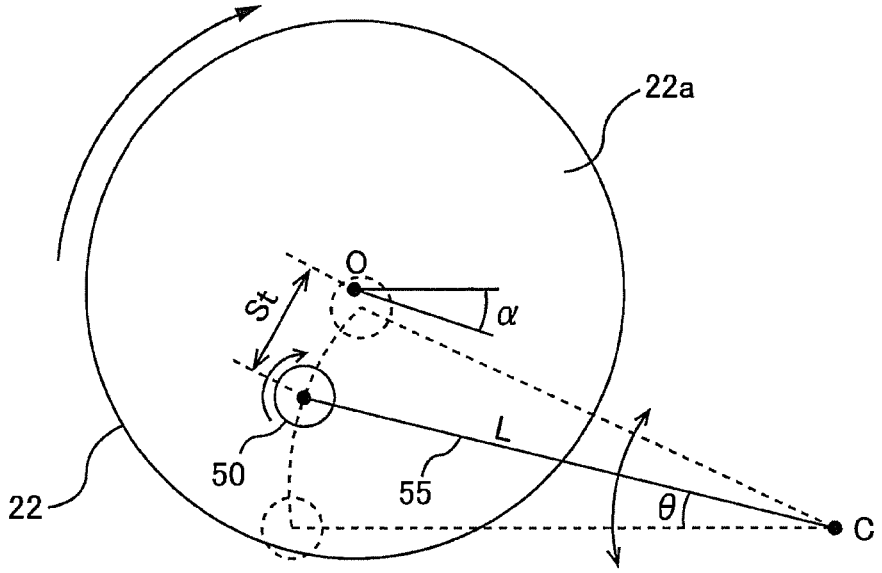
FIG. 2 is a plan view schematically showing a polishing pad and a dresser.

FIG. 2 is a schematic plan view of the polishing pad 22 and the dresser 50. The polishing table 12 and the polishing pad 22 thereon rotate about an origin O, while the dresser arm 55 revolves (i.e., pivots) about a predetermined point C through a predetermined angle to cause the dresser 50 to oscillate in the radial direction of the polishing pad 22. The position of the point C corresponds to a central position of the support shaft 58 shown in FIG. 1. The revolution angle $\theta$ of the dresser arm 55 about the point C is measured by the dresser rotary encoder 32.

A distance L between the dresser 50 and the point C which is the center of the pivoting motion of the dresser arm 55 is a known value given by a design of the polishing apparatus. A position of the center of the dresser 50 is determined from the position of the point C, the distance L, and the angle $\theta$. The table rotary encoder 31 and the dresser rotary encoder 32 are coupled to the pad monitoring device 60, so that a measured value of the rotation angle $\alpha$ of the polishing table 12 and a measured value of the revolution angle $\theta$ of the dresser 50 (the dresser arm 55) are sent to the pad monitoring device 60. This pad monitoring device 60 stores in advance the distance L between the dresser 50 and the point C and a relative position of the support shaft 58 with respect to the polishing table 12. A symbol St is a distance of the dresser 50 from the center of the polishing table 12, and varies according to the oscillation of the dresser 50.

Figure 3:
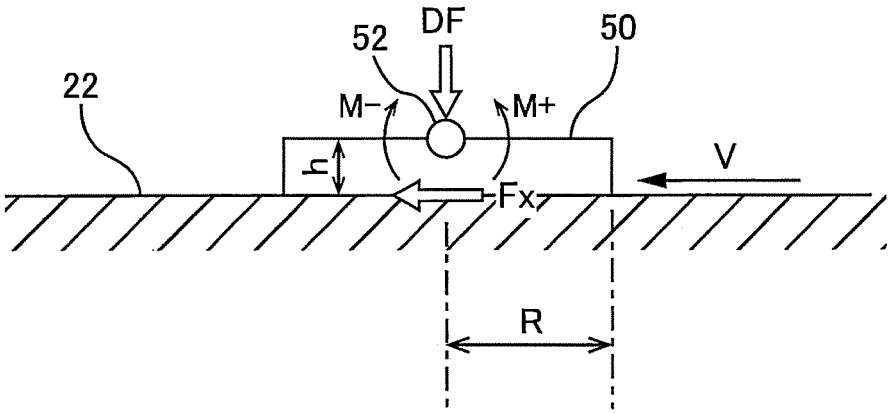
FIG. 3 is a schematic view showing the dresser for illustrating forces acting on the dresser when dressing the polishing pad.

FIG. 3 is a schematic view of the dresser 50 for illustrating forces that act on the dresser 50 when dressing the polishing pad 22. As shown in FIG. 3, the dresser 50 is tiltably coupled to the dresser shaft 51 by a swivel bearing 52. This swivel bearing 52 may be a spherical bearing, a leaf spring, or the like. While the dresser 50 is dressing the polishing pad 22, the dresser shaft 51 applies a downward force DF to the dresser 50. When the polishing table 12 rotates about its own axis, the polishing surface 22*a* of the polishing pad 22 on the polishing table 12 moves at a speed V relative to the dresser 50. When the polishing pad 22 is moving in this manner, it exerts a horizontal force Fx on the dresser 50. This horizontal force Fx corresponds to a frictional force that is generated between the lower surface (hereinafter referred to as "dressing surface") of the dresser 50 and the polishing surface 22*a* of the polishing pad 22 when the dresser 50 scrapes away the surface of the polishing pad 22.

Figure 4:
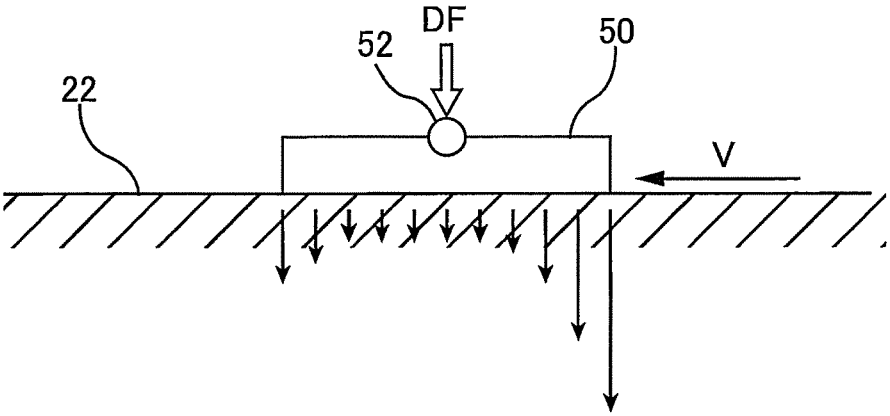
FIG. 4 is a schematic view showing a distribution of downward forces applied from the dresser to the polishing pad when the polishing pad is moving at a speed V.
Figure 5:
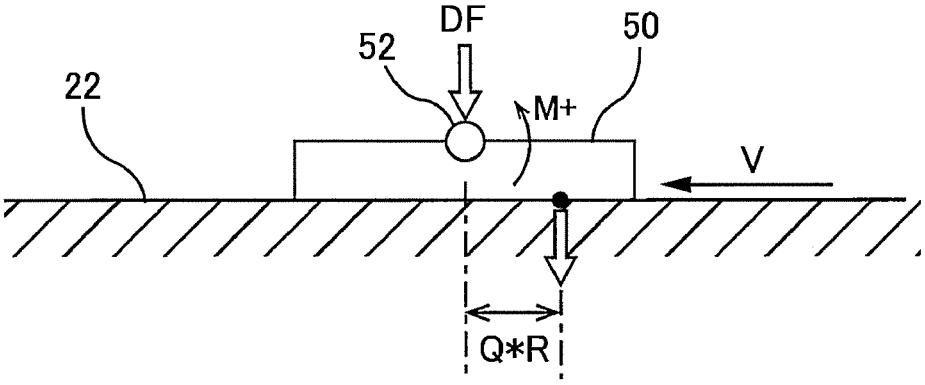
FIG. 5 is a view for illustrating moment of force acting on the dresser, assuming that uneven forces, which are distributed over a dressing surface, concentrate solely on a point on the polishing pad.

FIG. 4 is a schematic view showing a distribution of downward forces acting from the dresser 50 on the polishing pad 22 when the polishing pad 22 is moving at the speed V. Since the polishing pad 22 is moving at the speed V relative to the dresser 50 when the polishing pad 22 is being dressed by the dresser 50, the downward force DF acts unevenly on the surface of the polishing pad 22. As a result, the dresser 50 is subjected to a reaction force that causes the dresser 50 to rotate about the swivel bearing 52 in a counterclockwise direction. Assuming that uneven forces distributed over the dressing surface of the dresser 50 concentrate on one point on the polishing pad 22 as shown in FIG. 5, a moment of force $M^+$ in the counterclockwise direction about the swivel bearing 52 is expressed as $$M^+=Q*R*DF \tag{1}$$

where R represents a radius of the dressing surface, and Q represents a conversion coefficient for expressing, using the radius R, the distance between the center of the dressing surface and the point on which the uneven forces act when assuming that the uneven forces, distributed over the dressing surface of the dresser 50, concentrate on that point on the polishing pad 22 as shown in FIG. 5. The conversion coefficient Q is a numerical value smaller than 1.

A moment of force $M^-$ in a clockwise direction about the swivel bearing 52 is expressed as $$M^-=Fx*h \tag{2}$$

where h represents a distance between the dressing surface of the dresser 50 and the swivel bearing 52.

The horizontal force Fx corresponds to the frictional force between the dresser 50 and the polishing pad 22. Therefore, the horizontal force Fx and the downward force DF are basically correlated to each other. The relationship between the horizontal force Fx and the downward force DF is expressed using a coefficient Z as $$Fx=Z*DF \tag{3}$$

The coefficient Z will hereinafter be referred to as "work coefficient Z".

The moment of force M about the swivel bearing 52 is expressed as $$\begin{aligned} M &= M^+ - M^- \\ &= Q*R*DF - h*Z*DF \\ &= (Q*R - h*Z)*DF \end{aligned} \tag{4}$$

If the clockwise moment of force $M^-$ is larger than the counterclockwise moment of force $M^+$, the dresser 50 tends to be caught on the polishing pad 22 (i.e., stumble on the polishing pad 22), and as a result the attitude of the dresser 50 becomes unstable. Therefore, a stability condition of the dresser 50 when tilting about the swivel bearing 52 is that a value of Q*R−h*Z in parentheses of the equation (4) is positive. Specifically, the stability condition is $$Q*R-h*Z>0 \tag{5}$$

where Q represents the predetermined conversion coefficient, and R and h are fixed values that are uniquely determined from dimensions of the dresser 50. Therefore, the stability of the dressing process can be monitored by obtaining the work coefficient Z during the polishing process.

A process of obtaining the work coefficient Z will be described below. The horizontal force Fx can be calculated from the torque of the table motor 13 for rotating the polishing table 12 and the distance St (see FIG. 2) from the center of the polishing table 12 to the dresser 50, as follows.

$$Fx=(Tt-Tt_0)/St \tag{6}$$

In the above equation (6), Tt represents the torque generated by the table motor 13 during the dressing process and $Tt_0$ represents an initial torque generated by the table motor 13 before the dresser 50 is brought into contact with the polishing pad 22.

The torque of the table motor 13 is proportional to the current supplied to the table motor 13. Therefore, the torques Tt and $Tt_0$ can be determined by multiplying the current by a torque constant [Nm/A]. The torque constant is a constant inherent in the table motor 13, and can be obtained from specification data of the table motor 13. The current supplied from the motor driver 15 to the table motor 13 can be measured by the motor current measuring device 14.

During the dressing process, the dresser 50 oscillates in the radial direction of the polishing table 12. Therefore, the distance St between the dresser 50 and the center of the polishing table 12 periodically varies with a dressing time. The distance St can be calculated from the relative position between the center C about which the dresser 50 revolves and the center O of the polishing table 12, the distance L between the dresser 50 and the center C, and the revolution angle θ of the dresser arm 55.

Using the above-described equations (3) and (6), the work coefficient Z is given by $$\begin{aligned} Z &= Fx/DF \\ &= (Tt - Tt_0)/(DF*St) \end{aligned} \tag{7}$$

As can be seen from the equation (7), the work coefficient Z is a ratio of the force Fx, which is applied from the dresser 50 to the polishing pad 22 in a direction parallel to the polishing surface 22*a* of the polishing pad 22, to the force DF which is applied from the dresser 50 to the polishing pad 22 in a direction perpendicular to the polishing surface 22*a* of the polishing pad 22.

The pad monitoring device 60 calculates the work coefficient Z from the torque Tt of the table motor 13 during the dressing process, the initial torque $Tt_0$ of the table motor 13, the downward force DF acting on the dresser 50, and the distance St between the dresser 50 and the center of the polishing table 12 with use of the equation (7). The downward force DF can be measured by the load cell 17 incorporated in the dresser shaft 51. Alternatively, the downward force DF may be calculated by multiplying the pressure of the gas in the pneumatic cylinder 53 by the pressure-receiving area of a piston of the pneumatic cylinder 53.

Assuming that the radius R of the dressing surface is represented by k*h (k may be a value in the range of 2 to 10) and that the conversion coefficient Q is 0.5, it can be understood from the equation (5) that the dresser 50 becomes unstable when the work coefficient Z is larger than 0.5 k. The pad monitoring device 60 calculates the work coefficient Z when the polishing pad 22 is being dressed and monitors whether dressing of the polishing pad 22 is properly performed or not based on the work coefficient Z.

Figure 6:
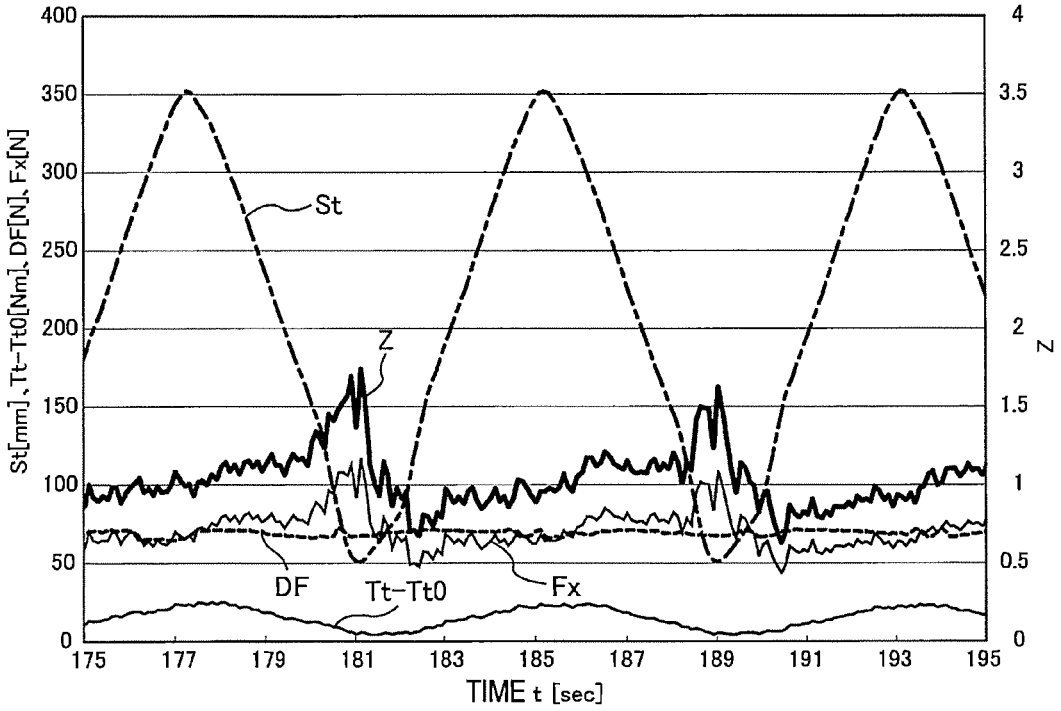
FIG. 6 is a diagram showing various data obtained during dressing of the polishing pad.

FIG. 6 is a diagram showing various data obtained when the polishing pad 22 is dressed. A left vertical axis in FIG. 6 represents the distance St [mm] from the center of the polishing table 12 to the center of the dresser 50, the downward force DF [N], the horizontal force Fx [N], and the torque difference $Tt-Tt_0$ [Nm], a right vertical axis represents the work coefficient Z, and a horizontal axis represents a dressing time. The oscillation of the dresser 50 in the radial direction of the polishing table 12 is best shown by the distance St from the center of the polishing table 12 to the center of the dresser 50. It can be seen from FIG. 6 that the work coefficient Z varies in synchronism with the oscillation of the dresser 50. More specifically, as the dresser 50 moves from the edge of the polishing pad 22 (polishing table 12) toward the center thereof, the work coefficient Z and the horizontal force Fx increase. When the dresser 50 is located at the center of the polishing pad 22, the work coefficient Z and the horizontal force Fx reach their maximums. This is because a vector of the dresser 50 when moving from the edge of the polishing pad 22 toward the center thereof has a component in a direction opposite to the direction in which the polishing table 12 rotates. As shown in FIG. 6, the work coefficient Z is a variable that can vary during the dressing process.

As shown in FIG. 6, an average of horizontal forces Fx throughout a total dressing time is approximately the same as the downward force DF. When the dresser 50 slides on the polishing pad 22, i.e., when the dresser 50 is not scraping the polishing pad 22, the work coefficient Z is zero. In FIG. 6, the work coefficient Z is approximately 1, and has a maximum value of 1.7 at the center of the polishing table 12. These figures indicate that the dresser 50 does not slide on the polishing pad 22, i.e., the dresser 50 is scraping the polishing pad 22. The dressing process with a large work coefficient Z is a process in which the dresser 50 greatly scrapes the polishing pad 22. In such a process, a remaining life of the dresser 50 is expected to decrease.

The pad monitoring device 60 judges that dressing of the polishing pad 22 is not properly performed if the work coefficient Z does not fall within a predetermined range. Preferably, the pad monitoring device 60 may judge that dressing of the polishing pad 22 is not properly performed if an average of work coefficients Z in one or plural dressing processes does not fall within a predetermined range.

The product of the horizontal force Fx and a travel distance S of the dresser 50 in a circumferential direction of the polishing pad 22 represents a work W [J] of the dresser 50, as indicated by an equation shown below. The travel distance S can be calculated from the distance from the center of the polishing table 12 (i.e., the polishing pad 22) to the dresser 50 and the rotational speed of the polishing table 12.

$$W=Fx*S[J] \tag{8}$$

The product of the horizontal force Fx and a travel distance dS/dt of the dresser 50 in the circumferential direction of the polishing pad 22 per unit time represents a power P [J/s] of the dresser 50, as indicated by an equation shown below.

$$P=Fx*(dS/dt)[J/s] \tag{9}$$

Both the work W [J] and the power P [J/s] of the dresser 50 are indexes that are suitable for predicting the remaining life of the dresser 50 which is a consumable product.

A method of predicting the remaining life of the dresser 50 which is a consumable product will be described below. Where an allowable total work of the dresser 50 is represented by W0 [J], a cumulative work of the dresser 50 is represented by W1 [J], and the work of the dresser 50 per unit time (i.e., the power) is represented by P [J/s], the remaining life (which is represented by Tend) of the dresser 50 is determined according to the following equation.

$$Tend[s]=(W0-W1)/P \tag{10}$$

The power P represents the latest work per unit time. The power P may be a moving average in a predetermined time interval.

As can be seen from the equation (3), when the work coefficient Z is 0, the horizontal force Fx is 0 regardless of the downward force DF acting on the polishing pad 22. This means that the dresser 50 does not scrape the polishing pad 22. As the abrasive grains of the dresser 50 become worn as a result of a long-term usage thereof, the dresser 50 tends to lose its ability to scrape the polishing pad 22. Thus, it is possible to determine a time for replacement of the dresser 50 from the work coefficient Z.

A method of predicting the remaining life of the dresser 50 with use of the work coefficient Z will be described below. Where an initial work coefficient is represented by Z0, a service-limit work coefficient is represented by Zend, and an amount of change in the work coefficient per unit time is represented by dZ/dt, the remaining life Tend of the dresser 50 is determined according to the following equation.

$$Tend[s]=(Z0-Zend)/(dZ/dt) \tag{11}$$

The work coefficient Z may be a moving average in a predetermined time interval. The amount of change in the work coefficient per unit time dZ/dt may be calculated from the moving average of the work coefficient Z.

The work coefficient Z and the amount of change in the work coefficient per unit time dZ/dt can be used for detection of a dressing failure. For example, if the work coefficient Z or the amount of change in the work coefficient per unit time dZ/dt has reached a predetermined threshold value, the pad monitoring device 60 may judge that the dressing process has suffered a failure. If the work coefficient Z or an average value thereof throughout the dressing process has reached the service-limit work coefficient Zend, the pad monitoring device 60 may judge that the dresser 50 has reached a time for replacement or has suffered a failure. Furthermore, if the calculated remaining life of the dresser 50 has reached a predetermined threshold value, the pad monitoring device 60 may generate a signal for urging a user to replace the dresser 50.

As described above, the pad monitoring device 60 can monitor the dressing process and can further monitor the remaining life of the dresser 50 based on the work coefficient Z that is obtained during the dressing process. Furthermore, the pad monitoring device 60 can produce an optimum dressing recipe based on the evaluation of the dressing process using the work coefficient Z.

The pad monitoring device 60 calculates the work coefficient Z throughout the dressing time in its entirety and determines the work coefficient Z at each point of time during the dressing process. The pad monitoring device 60 can identify the position of the dresser 50 on the polishing pad 22 at the time when it has determined the work coefficient Z, from the dimensions of the polishing apparatus and operation parameters of the dresser 50. Therefore, the pad monitoring device 60 is able to produce a distribution diagram of the work coefficient Z on the polishing pad 22 from the determined work coefficient Z and the identified position of the dresser 50 on the polishing pad 22.

Figure 7:
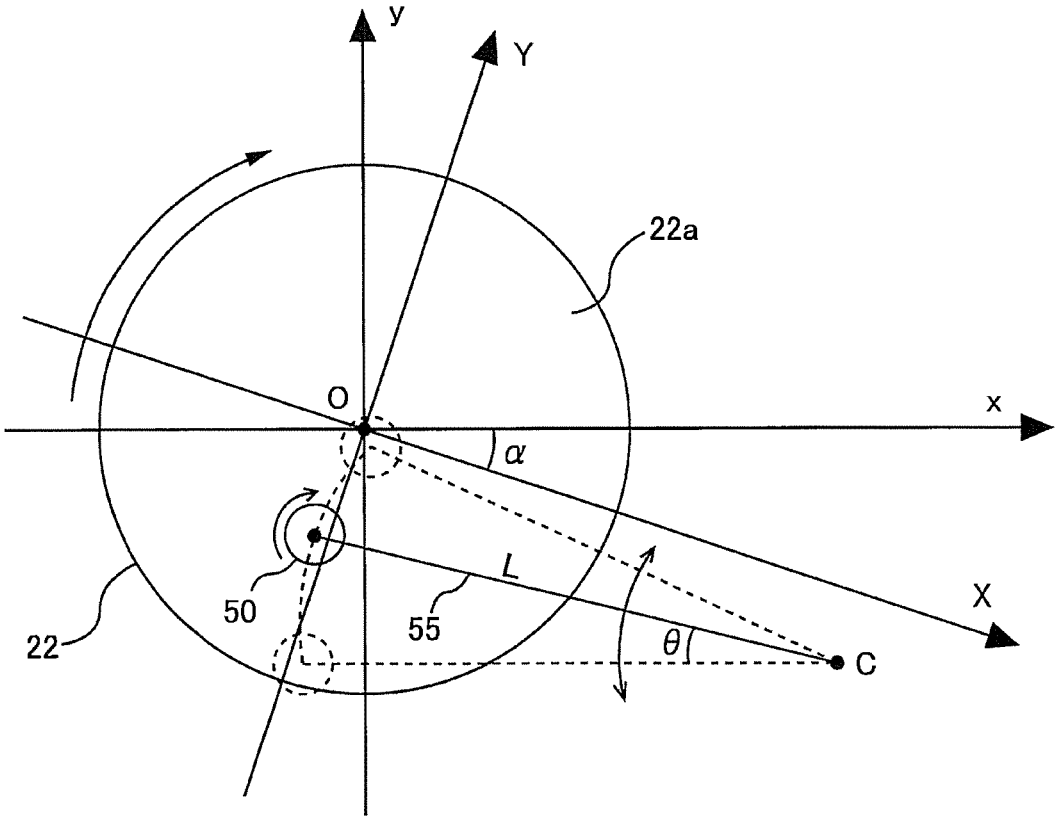
FIG. 7 is a plan view schematically showing the polishing pad and the dresser.

The pad monitoring device 60 produces the distribution diagram of the work coefficient Z on the polishing pad 22 as described below. FIG. 7 is a schematic plan view of the polishing pad 22 and the dresser 50. In FIG. 7, x-y coordinate system is a stationary coordinate system defined on the base 3 (see FIG. 1), and X-Y coordinate system is a rotating coordinate system defined on the polishing surface 22*a* of the polishing pad 22. As shown in FIG. 7, the polishing table 12 and the polishing pad 22 thereon rotate about the origin O of the x-y stationary coordinate system, while the dresser 50 revolves through a predetermined angle about the predetermined point C on the x-y stationary coordinate system.

Since the relative position of the polishing table 12 and the support shaft 58 is fixed, coordinates of the point C on the x-y stationary coordinate system are necessarily determined. The revolution angle θ of the dresser 50 about the point C is the pivoting angle of the dresser arm 55. This revolution angle θ is measured by the dresser rotary encoder 32. The rotation angle α of the polishing pad 22 (i.e., the polishing table 12) is an angle between a coordinate axis of the x-y stationary coordinate system and a coordinate axis of the X-Y rotating coordinate system. This rotation angle α is measured by the table rotary encoder 31.

Coordinates of the center of the dresser 50 on the x-y stationary coordinate system can be determined from the coordinates of the point C, the distance L, and the angle θ. Further, coordinates of the center of the dresser 50 on the X-Y rotating coordinate system can be determined from the coordinates of the center of the dresser 50 on the x-y stationary coordinate system and the rotation angle α of the polishing pad 22. Conversion of the coordinates on the stationary coordinate system into the coordinates on the rotating coordinate system can be carried out using known trigonometric functions and four arithmetic operations.

The pad monitoring device 60 calculates the coordinates of the center of the dresser 50 on the X-Y rotating coordinate system from the rotation angle α and the revolution angle θ as described above. The X-Y rotating coordinate system is a two-dimensional surface defined on the polishing surface 22*a*. That is, the coordinates of the dresser 50 on the X-Y rotating coordinate system indicate the relative position of the dresser 50 with respect to the polishing surface 22*a*. In this manner, the position of the dresser 50 is expressed as the position on the two-dimensional surface defined on the polishing surface 22*a*.

Each time the pad monitoring device 60 obtains the work coefficient Z through the above-described calculation, the pad monitoring device 60 identifies the coordinates on the X-Y rotating coordinate system where the work coefficient Z is obtained. The identified coordinates represent the position of the dresser 50 which corresponds to the work coefficient Z obtained. Further, the pad monitoring device 60 associates the work coefficients Z with the corresponding coordinates on the X-Y rotating coordinate system. The work coefficient Z and the associated coordinates are stored in the pad monitoring device 60.

Figure 8:
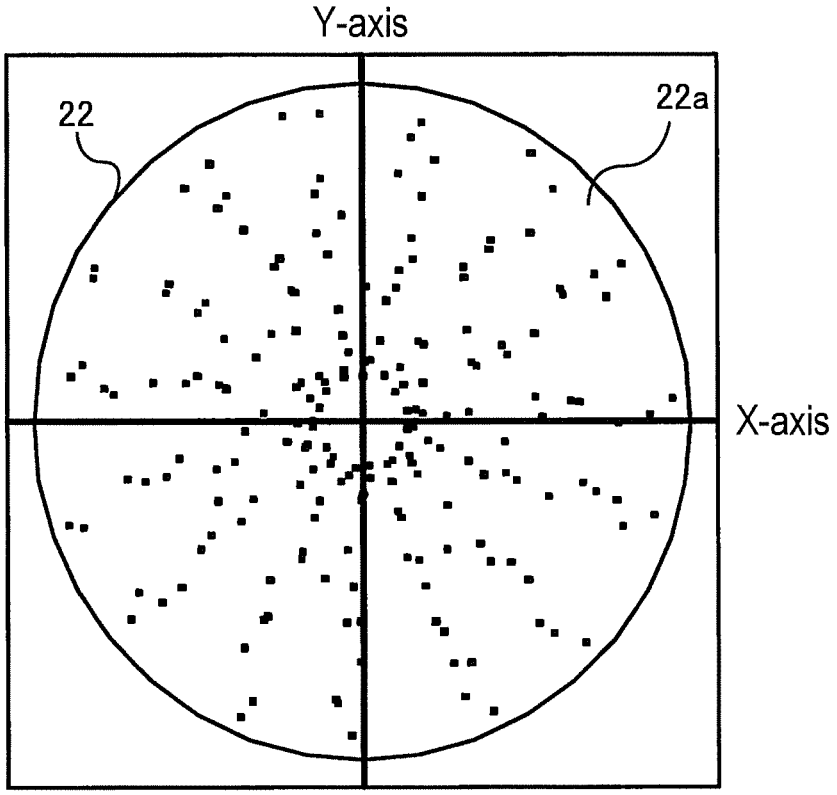
FIG. 8 is a diagram showing a work coefficient distribution.

When the edge of the dresser 50 is caught by the polishing surface 22*a* of the polishing pad 22, the dresser 50 scrapes away a local portion of the polishing pad 22, impairing the planarity of the polishing surface 22*a*. It can be seen from the expression (5) that the larger the work coefficient Z, the more likely the dresser 50 is caught by the polishing pad 22. Accordingly, the pad monitoring device 60 monitors whether the polishing surface 22*a* is flat or not, i.e., whether dressing of the polishing pad 22 is properly performed or not, based on the calculated work coefficient Z. Specifically, the pad monitoring device 60 generates a work coefficient distribution as shown in FIG. 8, which indicates abnormal points plotted or described on the X-Y rotating coordinate system defined on the polishing pad 22. Each of the abnormal points indicates a point where the work coefficient Z exceeds a predetermined threshold value.

The pad monitoring device 60 further has a function to calculate a density of the abnormal points described on the two-dimensional surface. Specifically, the pad monitoring device 60 calculates the density of the abnormal points in each of multiple zones defined on the two-dimensional surface, and determines whether the calculated density of the abnormal points in each of the zones exceeds a predetermined value or not. The zones are grid zones defined in advance on the X-Y rotating coordinate system on the polishing surface 22*a*.

Figure 9:
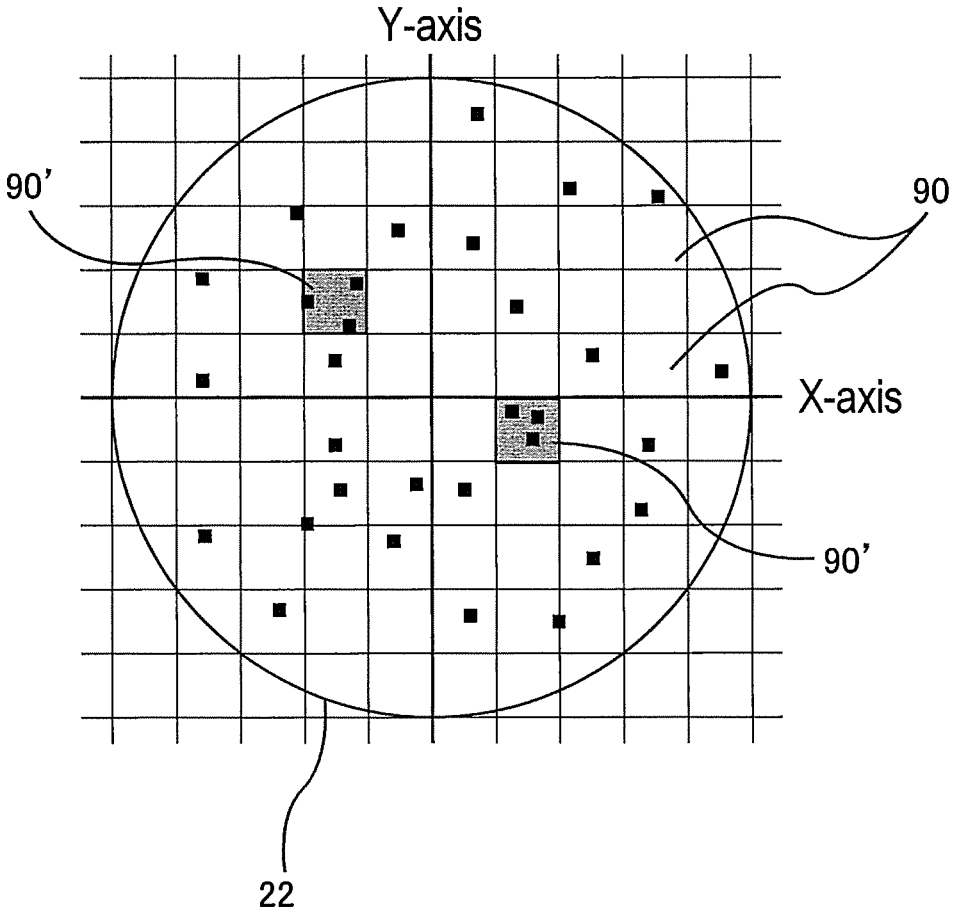
FIG. 9 is a diagram showing multiple zones defined on a X-Y rotating coordinate system.

FIG. 9 is a diagram showing the multiple zones defined on the X-Y rotating coordinate system. The density of the abnormal points in each of the zones 90 can be determined by dividing the number of abnormal points in each zone 90 by an area of the zone 90. Reference numeral 90' indicates a zone where the density of the abnormal points has reached a predetermined value. As shown in FIG. 9, the zone 90' may be colored. When the density of the abnormal points in at least one zone 90 exceeds the predetermined value, the pad monitoring device 60 outputs a signal indicating that dressing of the polishing pad 22 is not normally performed.

Since the abnormal points of the work coefficient Z are displayed on the two-dimensional surface, a user can replace the polishing pad 22 with a new polishing pad before the planarity of the polishing surface 22*a* is lost. Therefore, it is possible to prevent a decrease in a yield of products. In addition, the user is able to know whether dressing of the polishing pad 22 is normally performed or not while the polishing pad 22 is being dressed. In order for the user to be able to visually recognize the occurrence of abnormal points, it is preferable to show the density of the abnormal points by shading or intensity of color. Instead of the work coefficient Z, the amount of change in the work coefficient Z per unit time dZ/dt may be described on the two-dimensional surface.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims and equivalents.

What is claimed is:

1. A method of monitoring dressing of a polishing pad, said method comprising:

rotating a polishing table that supports the polishing pad;

dressing the polishing pad by pressing a dresser against the polishing pad while causing the dresser to oscillate in a radial direction of the polishing pad;

during dressing of the polishing pad, calculating a work of the dresser from a horizontal force exerted on the dresser and a travel distance of the dresser in a circumferential direction of the polishing pad;

calculating a power of the dresser from the horizontal force and the travel distance of the dresser in the circumferential direction of the polishing pad per unit time; and determining a remaining life of the dresser based on the work of the dresser and the power of the dresser.

2. The method according to claim 1, wherein:

the work is calculated from a product of the horizontal force and the travel distance of the dresser in the circumferential direction of the polishing pad, and the power is calculated from a product of the horizontal force and the travel distance of the dresser in the circumferential direction of the polishing pad per unit time.

3. The method according to claim 1, wherein the remaining life of the dresser is determined by Tend=(W0−W1)/P, where Tend represents the remaining life, W0 represents an allowable total work of the dresser, W1 is a cumulative work of the dresser, and P represents the power.

4. The method according to claim 1, wherein the travel distance is calculated from a distance of the dresser from a center of the polishing table and the rotational speed of the polishing table.

5. A method of monitoring dressing of a polishing pad, said method comprising:

rotating a polishing table that supports the polishing pad;

dressing the polishing pad by pressing a dresser against the polishing pad while causing the dresser to oscillate in a radial direction of the polishing pad;

during dressing of the polishing pad, calculating a work of the dresser from a horizontal force exerted on the dresser and a travel distance of the dresser in a circumferential direction of the polishing pad;

calculating a power of the dresser from the horizontal force and the travel distance of the dresser in the circumferential direction of the polishing pad per unit time;

calculating a moving average of the power in a predetermined time interval; and determining a remaining life of the dresser based on the work of the dresser and the moving average of the power of the dresser.

6. The method according to claim 5, wherein:

the work is calculated from a product of the horizontal force and the travel distance of the dresser in the circumferential direction of the polishing pad, and the power is calculated from a product of the horizontal force and the travel distance of the dresser in the circumferential direction of the polishing pad per unit time.

7. The method according to claim 5, wherein the remaining life of the dresser is determined by Tend=(W0−W1)/P, where Tend represents the remaining life, W0 represents an allowable total work of the dresser, W1 is a cumulative work of the dresser, and P represents the moving average of the power.

8. The method according to claim 5, wherein the travel distance is calculated from a distance of the dresser from a center of the polishing table and the rotational speed of the polishing table.

* * * * *